US012071266B1

(12) United States Patent
Edgar

(10) Patent No.: US 12,071,266 B1
(45) Date of Patent: Aug. 27, 2024

(54) SYSTEM AND METHOD FOR FILLING CONTAINERS WITH HIGH VISCOSITY LIQUID

(71) Applicant: David Edgar, Sugar Land, TX (US)

(72) Inventor: David Edgar, Sugar Land, TX (US)

( * ) Notice: Subject to any disclaimer, the term of this patent is extended or adjusted under 35 U.S.C. 154(b) by 31 days.

(21) Appl. No.: 18/106,846

(22) Filed: Feb. 7, 2023

Related U.S. Application Data

(60) Provisional application No. 63/307,209, filed on Feb. 7, 2022.

(51) Int. Cl.

| | |
|---|---|
| ***A24F 40/70*** | (2020.01) |
| ***B65B 3/04*** | (2006.01) |
| ***B65B 3/14*** | (2006.01) |
| ***B65B 63/08*** | (2006.01) |
| *A24F 40/10* | (2020.01) |
| *A24F 40/42* | (2020.01) |

(52) U.S. Cl.
CPC ..... *B65B 3/14* (2013.01); *A24F 40/70* (2020.01); *B65B 63/08* (2013.01); *A24F 40/10* (2020.01); *A24F 40/42* (2020.01)

(58) Field of Classification Search
CPC .. A24F 40/70; B65B 3/04; B65B 3/12; B65B 63/08
See application file for complete search history.

(56) References Cited

U.S. PATENT DOCUMENTS

| | | | | |
|---|---|---|---|---|
| 5,096,092 | A | 3/1992 | Devine | |
| 6,214,117 | B1 | 4/2001 | Prentice et al. | |
| 8,807,177 | B2 | 8/2014 | Strangis | |
| 10,440,989 | B2 * | 10/2019 | Gardella | B65B 39/12 |
| 10,583,949 | B1 * | 3/2020 | Ellis | B65B 3/12 |
| 10,850,874 | B2 | 12/2020 | Boldrini | |
| 10,982,899 | B1 | 4/2021 | Gelardi | |
| 11,166,490 | B2 * | 11/2021 | Gardella | B65B 29/00 |
| 11,612,189 | B2 * | 3/2023 | Chao | B65B 3/003 131/328 |
| 11,866,312 | B1 * | 1/2024 | Ellis | B65B 37/06 |
| 2001/0038020 | A1 | 11/2001 | Schalow et al. | |
| 2009/0045033 | A1 | 2/2009 | Hausladen et al. | |
| 2015/0129611 | A1 | 5/2015 | Vulpitta et al. | |

(Continued)

FOREIGN PATENT DOCUMENTS

| | | | |
|---|---|---|---|
| DE | 2020074548 | A1 | 4/2020 |

*Primary Examiner* — Paul J Gray

(74) *Attorney, Agent, or Firm* — AdamsIP, LLC; Edward B. Garner, III; J. Hunter Adams

(57) ABSTRACT

A system and method for method for filling containers with a viscous fluid is provided. Generally, the system warms heat exchange fluid contained within the vessel and circulates it in way such that viscous fluid contained within an inner hopper is maintained at a specified temperature so that its viscosity is increased, making the viscous fluid easier to precisely measure out. The system generally comprises a vessel, heater, inner hopper, and outer injector. The heater manages the temperature of the heat exchange fluid held within the vessel at a specified temperature needed to prevent a viscous fluid contained within the inner hopper and outer injector from becoming viscous to the point of clogging the various components of the system. A heat exchange mount in contact with the outer injector further prevents the viscous fluid from becoming too viscous.

17 Claims, 5 Drawing Sheets

(56) References Cited

U.S. PATENT DOCUMENTS

| | | | |
|---|---|---|---|
| 2015/0289565 | A1 | 10/2015 | Cadieux et al. |
| 2015/0320116 | A1 | 11/2015 | Bleloch et al. |
| 2015/0336689 | A1 | 11/2015 | Brown et al. |
| 2016/0128351 | A1 | 5/2016 | Rubin |
| 2017/0006921 | A1 | 1/2017 | Lemay et al. |
| 2017/0027223 | A1 | 2/2017 | Eksouzian |
| 2017/0121169 | A1 | 5/2017 | Dailey et al. |
| 2017/0233114 | A1 | 8/2017 | Christensen et al. |
| 2017/0304563 | A1 | 10/2017 | Adelson |
| 2017/0354180 | A1 | 12/2017 | Fornarelli |
| 2018/0170588 | A1 | 6/2018 | Boldrini |
| 2018/0215488 | A1 | 8/2018 | Sebastian et al. |
| 2018/0263283 | A1 | 9/2018 | Popplewell et al. |
| 2019/0091423 | A1 | 3/2019 | Tygett |
| 2019/0152627 | A1 | 5/2019 | Ghiotti et al. |
| 2019/0225479 | A1 | 7/2019 | Plecis |
| 2019/0329921 | A1 | 10/2019 | Thomas |
| 2021/0127743 | A1 | 5/2021 | Miller |
| 2021/0171231 | A1 | 6/2021 | Bumatai et al. |
| 2023/0389618 | A1* | 12/2023 | Bajpai ..... B65B 39/12 |

* cited by examiner

SYSTEM AND METHOD FOR FILLING CONTAINERS WITH HIGH VISCOSITY LIQUID

CROSS REFERENCES

This application claims the benefit of U.S. Provisional Application No. 63/307,209, filed on Feb. 7, 2022, which application is incorporated herein by reference.

FIELD OF THE DISCLOSURE

The subject matter of the present disclosure refers generally to a system and method for filling containers with high viscosity fluids.

BACKGROUND

Vape cartridges are hard to fill, and automatic filler machines have additional issues that semiautomatic and manual filling machines don't due to number of working parts that require precise coordination. Many automatic filler machines also require a very specific style of cartridge in order to work properly with said cartridge, which further reduces flexibility when working with automatic filler machines. However, regardless of the type of filler machine used, the more viscous distillates are very difficult to work with due to their propensity to clog the filler machine. This is particularly true for distillates such as CBD and its derivatives due to the low viscosity of these substances, and unless a heat source is applied to these distillates, they are bound to clog a filler machine and slow production. Even in situations where a heating source is applied to these more viscous distillates, it is common for clogs to occur in the needles of the injectors anyway. Additionally, the cost of machines that apply heat to these viscous distillates can be prohibitively expensive, effectively limiting people who otherwise might compete in the market.

Accordingly, there is a need in the art for a system that heats distillate and the injector in a way that prevents clogs from forming without greatly increasing the complexity of the system and, therefore, the cost to produce said system.

SUMMARY

A system and method for filling containers with a viscous fluid is provided. In one aspect, the system maintains a viscous fluid at a specified heat that prevents an injector from clogging when filling containers, wherein said containers may be used with a battery in a way that vaporizes the viscous fluid contained therein. In another aspect, the system allows a user to control the amount of viscous fluid that is injected into containers. Generally, the system and method warms heat exchange fluid contained within the vessel and circulates it in way such that viscous fluid contained within an inner hopper is maintained at a specified temperature so that its viscosity is increased, making the viscous fluid easier to precisely measure out. Therefore, in some embodiments, the system may be used as a precision measuring device to precisely distribute viscous fluid into a plurality of containers.

The controlled flow injection system generally comprises a vessel, heater, inner hopper, and outer injector. The heater manages the temperature of the heat exchange fluid held within the vessel at a specified temperature needed to prevent a viscous fluid contained within the inner hopper from becoming so viscous that it clogs the outer injector and/or the transfer tube connecting the inner hopper to the outer injector. A heat exchange mount configured to transfer heat from the vessel to the syringe of the outer injector prevents viscous fluid from clogging a needle of a self-filling syringe of the outer injector. The user can control the amount of viscous fluid distributed by the system using the user control, which controls the air compressor and, therefore, the hydraulic/pneumatic device of the system.

The vessel comprises an insulating shell and internal cavity that sits within said insulating shell, wherein a heat exchange fluid of the internal cavity is used to heat the viscous fluid that is to be transferred to a container. Types of heat exchange fluids that may be used by the system include, but are not limited to, water, oil, ionic liquids, or any combination thereof. The heater is configured warm the heat exchange fluid and keep it within a specific temperature range as required by the user. Types of heating elements of the heater that may be used by the system include, but are not limited to, resistance wire, ceramic heaters, thick film heaters, or any combination thereof. The power supply may be connected to a control board of the heater in a way such that the control board may regulate the amount of power the heating elements of the heater receive, thus granting the control board the ability to control the temperature within the internal cavity of the vessel. Types of power supplies that may supply the system with power include, but are not limited to, batteries, wall outlets, alternators, circuit boards, or any combination thereof. The pump is configured to move the heat exchange fluid about the internal cavity and into the heating elements of the heater.

The inner hopper is configured to sit within the vessel and hold a volume of viscous fluid therein, wherein said viscous fluid is then heated by the heat exchange fluid through said inner hopper. A transfer tube running from the bottom of the inner hopper, through the insulated wall of the vessel, and into the outer injector allows for removal of the viscous fluid from the inner hopper. The inner hopper is preferably removably secured within the vessel via an opening on the top surface of the vessel, allowing the inner hopper to be removed from the exterior of the vessel. The heater may also be removably secured to the vessel on the top surface, allowing the heater to be removed from the exterior of the vessel. The openings of the top surface may be used to add additional heat exchange fluid to the internal cavity if the heat exchange fluid becomes too low.

The outer injector comprises a hydraulic/pneumatic device, adjustable adapter, self-filling syringe, and adapter/check valve and is configured to transfer viscous fluid into a container. An air compressor preferably manipulates the action of the outer injector, causing the pressure within the inner hopper and outer injector to be manipulated in a way that allows a user to precisely control the amount of viscous fluid injected into the container. The control valve of the hydraulic/pneumatic device directs the hydraulic/pneumatic fluid to various locations of the outer injector and/or inner hopper via a plurality of tubes. The actuator is responsible for compressing a plunger of the self-filling syringe, which causes an ejection of the viscous fluid contained within. Preferably, a spring of the self-filling syringe pushes the syringe back into a starting position, causing the self-filling syringe to fill with fluid. The user may control the amount of viscous fluid ejected by the outer injector via a user control. Alternatively, the actuator is responsible for returning the plunger of the self-filling syringe to a starting position via pressure changes within an adjustable adapter that connects the hydraulic/pneumatic device and self-filling syringe, wherein the pressure changes result from the work force generated by the hydraulic/pneumatic fluid within the hydraulic/pneumatic cylinder.

The barrel of the self-filling syringe is at least partially secured to the exterior surface of the vessel and/or the heat exchange mount, which will result in heat transfer from the vessel and/or heat exchange mount to the syringe. As the syringe absorbs heat energy from the vessel and/or heat exchange mount, the viscous fluid within the syringe will also absorb heat energy, preventing the viscous fluid from losing too much heat energy before being transferred to the container, which may otherwise result in the viscous fluid clogging the self-filling syringe. The heat exchange mount is preferably configured to envelope a portion of the self-filling syringe, resulting in additional heat exchange that prevents the viscous fluid from becoming too viscous. The heat exchange mount may also be configured to contain at least a portion of transfer tube. In some embodiments, the vessel may be configured so that the insulating shell allows for heat to transfer more efficiently from the heat exchange fluid to the outer injector and/or heat exchange manifold.

Although a few variations have been described in detail above, other modifications or additions are possible. Further features and/or variations can be provided in addition to those set forth herein. For example, the implementations described above can be directed to various combinations and sub-combinations of the disclosed features and/or combinations and sub-combinations of several further features disclosed above. In addition, any methods discussed in the accompanying figures and/or described herein do not necessarily require the particular order shown, or sequential order, to achieve desirable results. It will be readily understood to those skilled in the art that various other changes in the details, materials, and arrangements of the parts and process stages which have been described and illustrated to explain the nature of this inventive subject matter can be made without departing from the principles and scope of the inventive subject matter.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For instance, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, steps, etc. are optionally present. For instance, a system "comprising" components A, B, and C can contain only components A, B, and C, or can contain not only components A, B, and C, but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
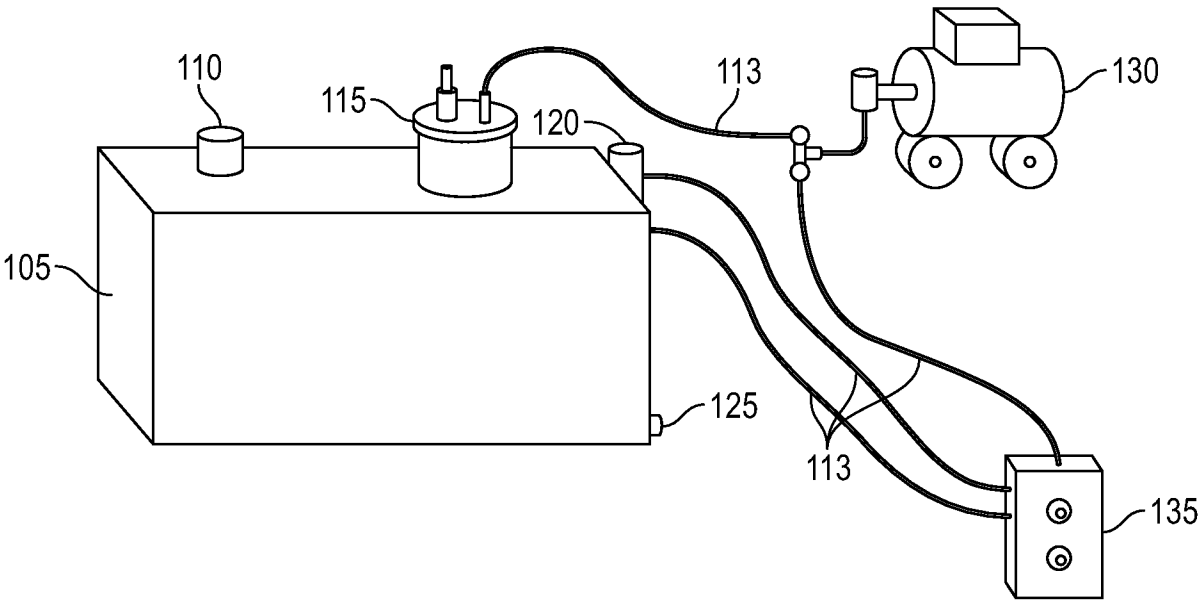
FIG. 1 is a diagram illustrating a system embodying features consistent with the principles of the present disclosure.
Figure 2:
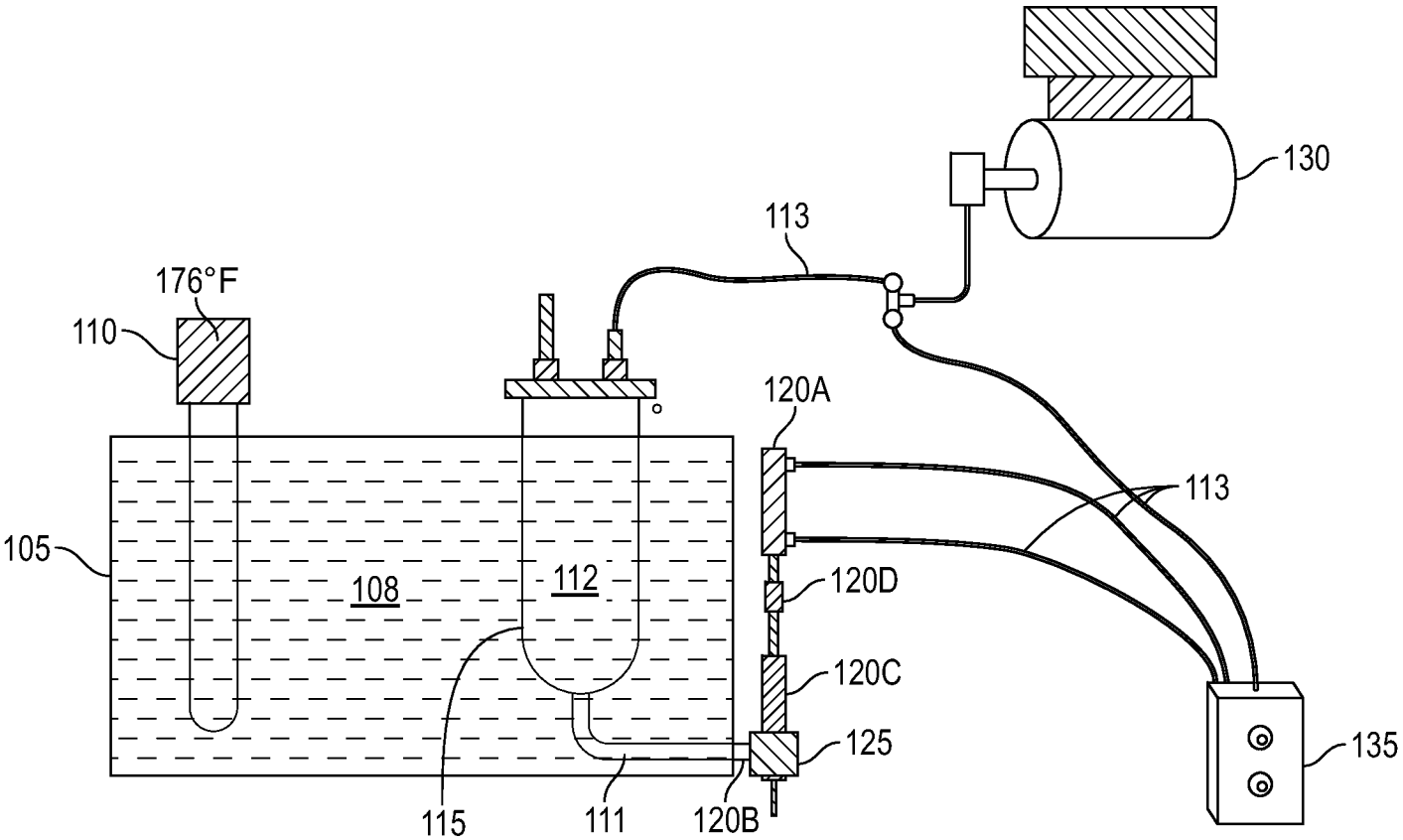
FIG. 2 is a diagram illustrating a system embodying features consistent with the principles of the present disclosure.
Figure 3:
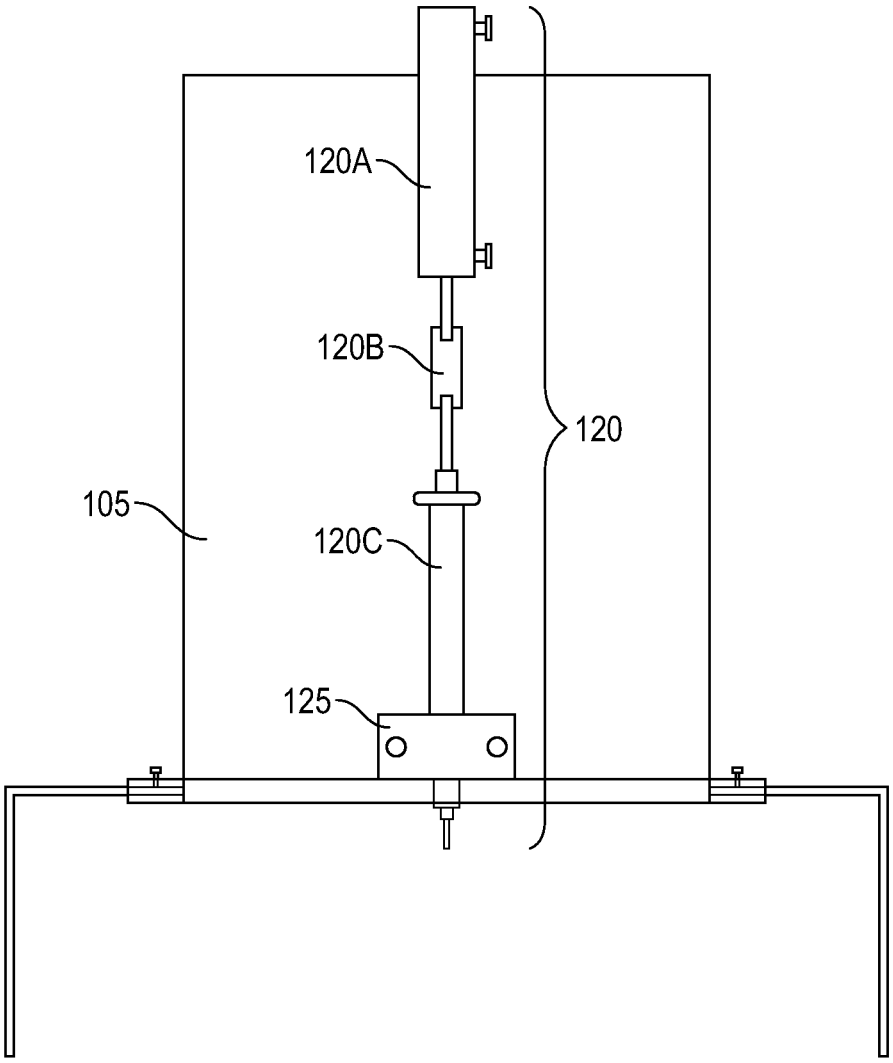
FIG. 3 is a diagram illustrating a system embodying features consistent with the principles of the present disclosure.
Figure 4:
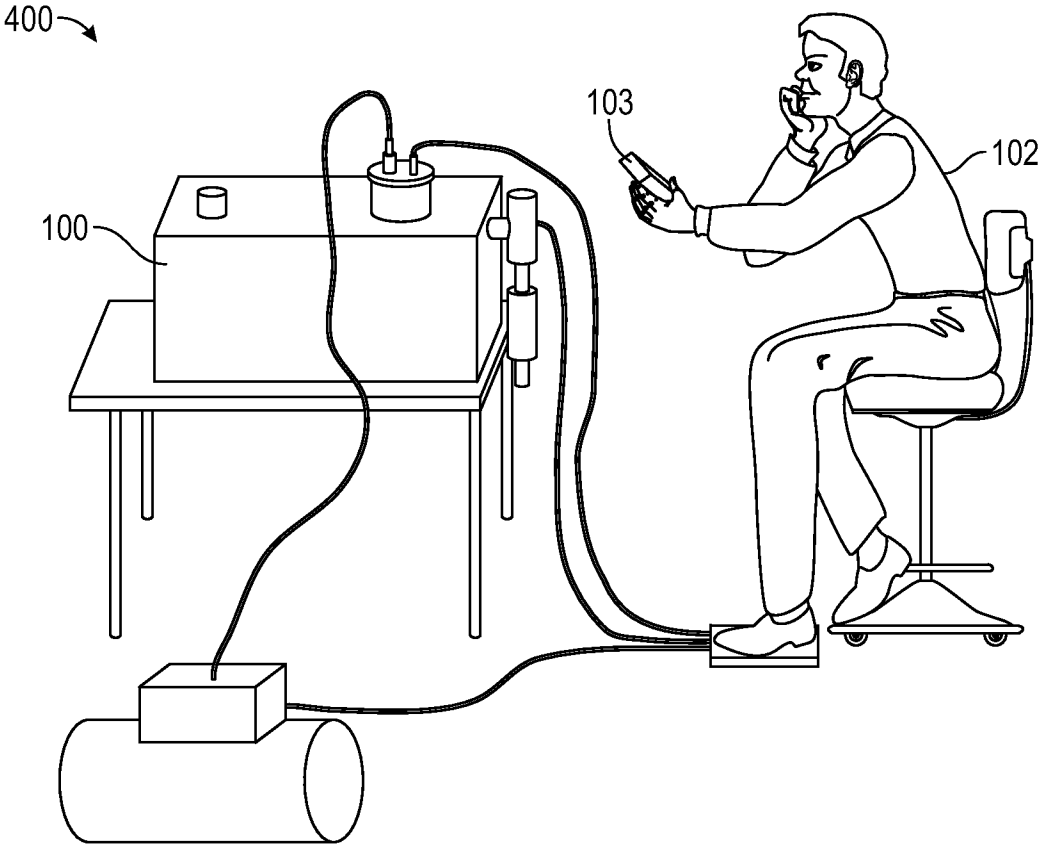
FIG. 4 is a diagram illustrating a system being used within an environment by user in order to fill containers with a viscous fluid.
Figure 5:
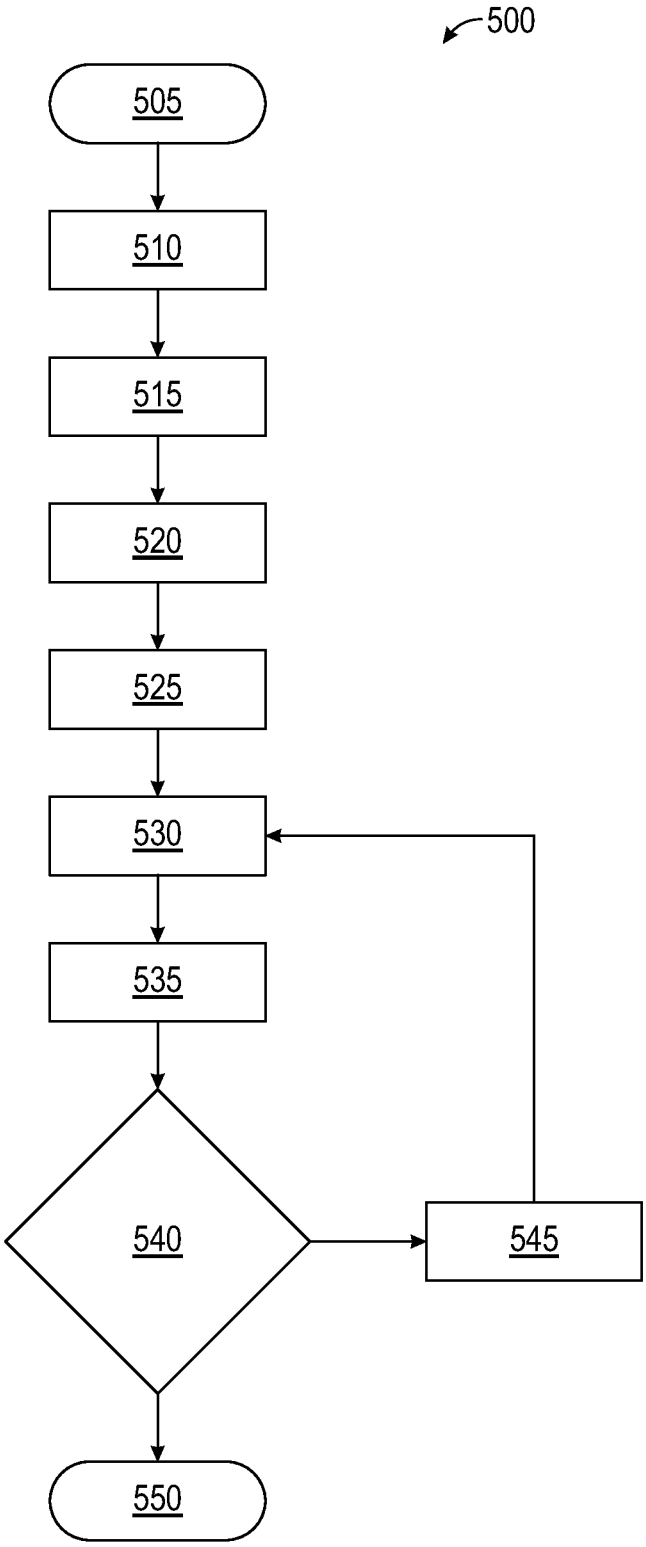
FIG. 5 is a flow chart illustrating certain method steps of a method embodying features consistent with the principles of the present disclosure.

FIGS. 1-5 illustrate embodiments of a controlled flow injection system 100 and its methods of use. FIG. 1 illustrates a perspective view of a controlled flow injection system 100 used to fill containers 103 with a viscous fluid 112. FIG. 2 illustrates a cross-sectional view of a system 100 used to fill containers 103 with a viscous fluid 112. FIG. 3 illustrates front view of a system 100 used to fill containers 103 with a viscous fluid 112. FIG. 4 illustrates an environmental view of a container 103 being injected with the viscous fluid 112 within an environment 400 by a user 102. FIG. 5 illustrates a method that may be carried out by a user 102 using the system 100 to fill containers 103. It is understood that the various method steps associated with the methods of the present disclosure may be carried out as operations by the system 100 depicted in FIGS. 1-4. Containers 103 that the system 100 may be used to fill with viscous fluid 112 include, but are not limited to, vape cartridges, capsules, straws, bottles, or any combination thereof.

The system 100 generally comprises a vessel 105, heater 110, inner hopper 115, and outer injector 120. The heater 110 manages the temperature of the heat exchange fluid 108 held within the vessel 105 at a specified temperature needed to prevent a viscous fluid 112 contained within the inner hopper 115 from becoming so viscous that it clogs the outer injector 120 and/or the transfer tube 111 connecting the inner hopper 115 to the outer injector 120. A heat exchange mount 125 configured to transfer heat from the vessel 105 to the syringe of the outer injector 120 reduces the likelihood of the viscous fluid 112 clogging a needle of a self-filling syringe 120C of the outer injector 120. The user 102 may control the amount of viscous fluid 112 distributed by the system 100 using the user control 135, which controls the air compressor and, therefore, the hydraulic/pneumatic device 120A of the system 100.

The vessel 105 comprises an insulating shell and internal cavity that sits within said insulating shell, wherein a heat exchange fluid 108 of the internal cavity is used to heat the viscous fluid that is to be transferred to a container 103. In a preferred embodiment, the heat exchange fluid 108 is contained within the internal cavity and transfers heat energy from a heater 110 to an inner hopper 115, wherein the heat energy is then transferred from the inner hopper 115 to the viscous fluid. However, in some preferred embodiments, an external jacket may be secured to the exterior of the insulating shell, wherein a heat exchange fluid 108 may be circulated through said external jacket in a way such that said heat exchange fluid 108 contacts the exterior surface of the insulting shell to promote heat transfer from an external heat exchange fluid 108 of the jacket to the insulated shell and finally to an internal heat exchange fluid 108 contained within the internal cavity of the vessel 105. Therefore, in some preferred embodiments, the system 100 may comprise more than one heat exchange fluid 108 that may be used to transfer heat energy to the various components of the system 100. For instance, a vessel 105 comprising a jacket may comprise a heating oil that acts as an external heat exchange fluid 108 and water that acts as an internal heat exchange fluid 108. Because jackets allow for the direction of heat to specific sections of the vessel 105, such as areas in which tubing moves from the interior of the vessel 105 to the exterior of the jacketed vessel 105, more efficient use of heat energy may be achieved. Other vessel 105 geometries and configurations may be utilized in accordance with the present disclosure.

The heater 110 is configured to warm the heat exchange fluid 108 and keep it within a specific temperature range as required by the user 102. In a preferred embodiment, the heater 110 is a thermal immersion circulator, which both warms and circulates the heat exchange fluid 108 within the internal cavity of the vessel 105 in a way that keeps the temperature stable. The thermal immersion circulator preferably comprises a heating element, water pump, temperature probe, and control board. The heating elements are configured to heat the heat exchange fluid 108, wherein said heating elements are operably connected to the control board in a way such that they may receive power from a power supply. In a preferred embodiment, the heating elements increase in temperature due to resistive heating in which resistance within the heating elements causes an increase in temperature of the heating elements as electricity is passed through. Types of heating elements that may be used by the system 100 include, but are not limited to, resistance wire, ceramic heaters, thick film heaters, or any combination thereof. The power supply may be connected to the control board in a way such that the control board may regulate the amount of power the heating elements receive, thus granting the control board the ability to control the temperature within the internal cavity of the vessel 105. Types of power supplies that may supply the vessel 105 with power include, but are not limited to, batteries, wall outlets, alternators, circuit boards, or any combination thereof.

In a preferred embodiment, the pump is configured to move water from the internal cavity to the heating elements with the heater 110 and back into the internal cavity. Some versions of the heater 110 may comprise a directional device that allows a user 102 to direct the pump in order to control the direction of the flow of water into and out of the pump, which may control the amount of circulation of the heat exchange fluid 108 within the vessel 105. The heater 110 is preferably secured to the vessel 105 using an attachment element, such as a clamp, hanger, or suction cup. In other preferred embodiments, the heater 110 may be configured to be secured within an opening of the vessel 105, allowing the heater 110 to be removed from the exterior of the vessel 105. Further, the opening may be used to add additional heat exchange fluid 108 to the internal cavity if the heat exchange fluid 108 becomes too low. In a preferred embodiment, the opening for the heater is located on a top surface of the vessel.

The control board preferably comprises at least one circuit and microchip and may regulate the transfer of power to the various elements of the heater 110. The control board is configured to manage the temperature of the heat exchange fluid 108 within the internal cavity based on temperature data received from the sensor. The microchip of the control board comprises a microprocessor memory, and in some preferred embodiments, the control board may further comprise an antenna. The microprocessor may be defined as a multipurpose, clock driven, register based, digital-integrated circuit which accepts binary data as input, processes it according to instructions stored in its memory, and provides results as output. In a preferred embodiment, the microprocessor may receive a signal to start the heating/circulating process from a switch on the heater 110 that is operably connected to the control board, wherein the switch completes a circuit of the control board that allows the control board to receive power from the power supply. Alternatively, in embodiments with an antenna, the microprocessor may receive instructions from a computing device that may instruct the heater 110 to start a heating/circulating process, wherein the instructions for said heating/circulating process is saved within the memory. For instance, a communication device may transmit a computer readable signal to the microprocessor of the microchip via the antenna that cause the microprocessor to retrieve heating/circulating process instructions from the memory that instruct the processor in how to carry out said heating/circulating process.

Memory may be defined as a device capable of storing information/instructions permanently or temporarily. In the preferred embodiment, memory of the microchip stores information pertaining to heating/circulating processes within. This data may include, but is not limited to, minimum/maximum temperature, pump speed, heating/circulating process instructions (including temperature and duration), etc. In some preferred embodiments, memory may include one or more volatile memory units. In another preferred embodiment, memory may include one or more non-volatile memory units. A memory device may refer to storage space within a single storage device or spread across multiple storage devices. Types of devices that may act as memory may include, but are not limited to, read only memory (ROM), random access memory (RAM), and flash memory. ROM may comprise a conventional ROM device or another type of static storage device that stores static information and instructions for execution by the microprocessor. RAM may comprise a conventional RAM device or another type of dynamic storage device that stores information and instructions for execution by the processor.

The inner hopper 115 is configured to sit within the vessel 105 and hold a volume of viscous fluid 112 therein, wherein said viscous fluid 112 is then heated by the heat exchange fluid 108. The inner hopper 115 is preferably constructed of a material that is a good conductor of heat and/or a material that is inert. The inner hopper 115 may be configured to be secured within a second opening of the vessel 105, allowing the inner hopper 115 to be removed from the exterior of the vessel 105. The second opening of the vessel is preferably located on the top surface of said vessel. A top opening of the inner hopper 115 allows for the system 100 to regulate pressure within the inner hopper 115 as viscous fluid 112 is pulled out the bottom of the inner hopper 115 by the outer injector 120. In some preferred embodiments, an air tube connected to the inner hopper 115 at the top opening transfers air from an air supply 130 and into the inner hopper 115 in way that regulates the pressure within the inner hopper 115. A transfer tube 111 running from the bottom of the inner hopper 115, through the insulated wall of the vessel 105, and to the outer injector 120 allows for removal of the viscous fluid 112 from the inner hopper 115. In addition, some embodiments of the inner hopper 115 comprises a motor and agitator assembly, which may be used for stirring the contents of the inner hopper 115. The motor and agitator assembly is preferably secured to the top opening; however, some embodiments of the motor and agitator assembly may comprise a magnetic stir bar and a rotating magnetic plate located within the internal cavity of the vessel 105. As the magnetic plate spins, a stir bar located within the inner hopper 115 will spin with the magnetic plate, agitating the viscous fluid 112 located within the inner hopper 115.

In a preferred embodiment, the outer injector 120 transfers viscous fluid 112 into a container 103, wherein an air compressor manipulates the action of the outer injector 120 and the pressure within the inner hopper 115 in a way that allows a user 102 to precisely control the amount of viscous fluid 112 injected into the container 103. The outer injector 120 comprises a hydraulic/pneumatic device 120A, adjustable adapter 120B, self-filling syringe 120C, and adapter/check valve 120D. The outer injector 120 is connected to the inner hopper 115 via the transfer tube 111 that runs from the base of the inner hopper 115 to the adapter/check valve 120D that leads to the exterior of the vessel 105 where it connects to the self-filling syringe 120C. A hydraulic/pneumatic device 120A may be defined as an engine that does work using hydraulic/pneumatic fluid as the powering medium. In an embodiment, the hydraulic/pneumatic device 120A may comprise an engine, hydraulic/pneumatic pump, hydraulic reservoir, hydraulic/pneumatic fluid, control valves, user control 135, actuator connected to the hydraulic/pneumatic pump via a plurality of tubes 113, and a plurality of seals. The hydraulic/pneumatic pump supplies the hydraulic/pneumatic fluid to the various components of the hydraulic/pneumatic device 120A. In the preferred embodiment illustrated in FIGS. 1-4, the hydraulic/pneumatic pump is an air supply 130.

The control valves direct the hydraulic/pneumatic fluid to various locations of the outer injector 120 and/or inner hopper 115 via the plurality of tubes 113. In a preferred embodiment, a switch connected to the control valves instruct the control valves which route through the plurality of tubes 113 the hydraulic/pneumatic fluid may take to the actuator. The actuator is responsible for compressing a plunger of the self-filling syringe 120C, which causes an ejection of the viscous fluid 112 contained within. Preferably, a spring of the self-filling syringe 120C pushes the syringe back into a starting position, causing the self-filling syringe 120C to fill with viscous fluid 112. As such, the spring must be strong enough to push the plunger back to a starting position and create a pressure differential that allows the self-filling syringe 120C to fill with the viscous fluid 112. Additionally, the pressure created by the hydraulic/pneumatic device 120A must dissipate after ejection of the viscous fluid 112 to allow for the spring to push the plunger back to the starting position. In a preferred embodiment, the hydraulic/pneumatic device 120A is configured to release the pressure created once a user 102 releases the user control 135, allowing the spring to return the plunger the starting position.

Alternatively, the actuator is responsible for returning the plunger of the self-filling syringe 120C to a starting position via pressure changes within an adjustable adapter 120B that connects the hydraulic/pneumatic device 120A and self-filling syringe 120C, wherein the pressure changes result from the work force generated by the hydraulic/pneumatic fluid within the hydraulic/pneumatic cylinder. The hydraulic reservoir holds hydraulic/pneumatic fluid not currently being used to operate the hydraulic/pneumatic device 120A. However, in embodiments in which the hydraulic/pneumatic fluid is air, as illustrated in FIGS. 1-4, it may not be necessary to include a hydraulic reservoir. The plurality of seals may prevent or regulate the escape of hydraulic/pneumatic fluid from the hydraulic/pneumatic device 120A. For instance, a seal on the top of the inner hopper 115 may regulate the amount of pressure contained within the inner hopper 115.

In an embodiment, the actuator comprises a hydraulic/pneumatic cylinder defined by a hydraulic/pneumatic cavity, and a slidably moveable piston disposed within the hydraulic/pneumatic cavity. The slidably moveable piston may be shaped in a way such that it creates two chambers within the hydraulic/pneumatic cavity. In a preferred embodiment, the hydraulic/pneumatic cylinder may be operably connected to the hydraulic/pneumatic pump and control valves via the plurality of tubes 113 in a way such that hydraulic/pneumatic fluid may be pumped into one of a first chamber or a second chamber of the hydraulic/pneumatic cylinder by the hydraulic/pneumatic pump. Pressure change resulting from hydraulic/pneumatic fluid being injected into the first chamber or second chamber acts on the slidably moveable piston, causing the slidably moveable piston to move in a direction from higher pressure to lower pressure. In some embodiments, a strut operably connected to the slidably moveable piston may manipulate the self-filling syringe. The strut is projected out the strut end of the hydraulic/pneumatic device 120A and is secured to the plunger of the self-filling syringe 120C, causing the barrel of the syringe to fill with or eject viscous fluid 112 based on the direction of movement of the strut.

In a preferred embodiment, the barrel of the self-filling syringe 120C is at least partially secured to the exterior surface of the vessel 105, resulting in heat transfer from the vessel 105 to the self-filling syringe 120C. This heat exchange may prevent the viscous fluid 112 from becoming too viscous before transfer to a container 103, resulting in a lower likelihood that the viscous fluid 112 will clog the self-filling syringe 120C due to it having a higher viscosity from the heat transfer. Additionally, the heat exchange mount 125 may be configured to envelope at least a portion of the self-filling syringe 120C and be secured to the vessel 105, allowing for heat transfer from the vessel to the viscous fluid contained within the outer injector 120. In some preferred embodiments, the jacketed vessel may comprise lesser insulation and/or comprise a good heat conductive material where the external mount is secured thereto. Alternatively, the heat exchange mount 125 may be integrated into the insulating wall and/or jacket so that it may be more directly heated by the heat exchange fluid contained within the vessel. Regardless, the heat exchange mount 125 is configured to be receive heat from the heat exchange fluid 108 within the vessel 105 so that it may transfer said heat to the viscous fluid 112 contained within the self-filling syringe 120C, preventing the viscous fluid 112 from losing too much heat and becoming too viscous for transfer to a container 103 due to clogging of the self-filling syringe 120C by the cooler, more viscous version of the viscous fluid 112.

As previously mentioned, the hydraulic/pneumatic fluid of the hydraulic/pneumatic device 120A is preferably air from an air supply 130. The air supply 130 is configured to supply air to the outer injector 120 and/or inner hopper 115 so that the viscous fluid 112 contained therein may be transferred to a container 103. In a preferred embodiment, the air supply 130 is operably connected to the outer injector 120 and/or inner hopper 115 via a plurality of tubes 113. Types of air supplies that may be used by the system 100 include, but are not limited to, an air pump, air compressor, compressed air/gas canister, or any combination thereof. In a preferred embodiment, an air compressor is used to distribute pressurized air to the outer injector 120 and/or inner hopper 115. Types of air compressors that may be used by the system 100 include, but are not limited to, reciprocating, centrifugal, axial, and rotary screw. The user control 135 is operably connected to the air compressor and hydraulic/pneumatic device 120A of the outer injector 120, which allows a user 102 to control the action of the pneumatic hydraulic device in a way that causes the self-filling syringe 120C to fill with or eject the viscous fluid 112. In a preferred embodiment, the user control 135 is a pedal, as illustrated in FIGS. 1-4.

FIG. 5 provides a flow chart 500 illustrating certain, preferred method steps that may be used to carry out the method of filling a container 103 with viscous fluid 112 using the system 100. Step 505 indicates the beginning of the method. During step 510, a user 102 may obtain a system 100 having viscous fluid 112 therein and a plurality of containers 103 with which to fill with said viscous fluid 112. The user 102 may then activate the heater 110 and air supply 130 of the system 100 during step 515. Once the heater 110 and air supply 130 have been activated, the user 102 may manipulate the heater 110 to heat the heat exchange fluid 108 of the vessel 105 to a temperature that will increase the viscosity of the viscous fluid 112 during step 520. The user 102 may position a container 103 under the self-filling syringe 120C during step 525 and subsequently manipulate the user control 135 in a way that causes the hydraulic/pneumatic device 120A to manipulate pressure within the adapter/check valve 120B connecting the self-filling syringe 120C to the pneumatic cylinder in a way that causes the system 100 to eject viscous fluid 108 out of a needle of the syringe during step 530.

The user 102 may then perform a query during step 535 to determine if more viscous fluid 112 is required to fill said container 103. Based on the results of that query, a user 102 may take an action during step 540. If a user 102 determines that no more viscous fluid 112 is required to fill said container 103, the user 102 may proceed to terminate method step 550. If the user 102 determines that more viscous fluid 112 is required to fill a container 103, the user 102 may manipulate the user control 135 in a way that causes the hydraulic/pneumatic device 120A to manipulate the adapter/check valve 120B connecting the self-filling syringe 120C to the pneumatic cylinder in a way that causes the system 100 to intake viscous fluid 112 into self-filling syringe 120C during step 545. Additionally, manipulation of the user control 135 in this way simultaneously causes the air supply 130 to pump air into the inner hopper 115, which balances out the pressure differential created as viscous fluid 112 is removed from the inner hopper 115 while being sucked into the barrel of the self-filling syringe 120C. Once the self-filling syringe 120C has been refilled with viscous fluid 112, the user 102 may return to step 530.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For instance, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, materials, and arrangements of the parts and method stages which have been described and illustrated in order to explain the nature of this inventive subject matter can be made without departing from the principles and scope of the inventive subject matter.

What is claimed is:

1. A system for filling containers with a viscous fluid comprising, a vessel having an insulated shell and a heat exchange mount, wherein said insulated shell has an internal cavity filled with a heat exchange fluid, wherein said insulated shell allows for said heat exchange fluid to transfer heat to said heat exchange mount, a heater having a heating element and pump, wherein said heater is secured to a top surface of said insulated shell of said vessel, wherein said heating element of said heater is positioned within said heat exchange fluid contained within said internal cavity of said vessel, wherein said heating element of said heater is configured to heat said heat exchange fluid to a specific temperature, wherein said pump is configured to regulate a flow of heat exchange fluid within said internal cavity, an inner hopper configured to hold said viscous fluid, wherein said inner hopper is secured to said top surface of said insulated shell of said vessel, wherein said inner hopper is positioned within said heat exchange fluid contained within said internal cavity of said vessel, wherein an opening of said inner hopper allows for removal of said viscous fluid from said inner hopper, a transfer tube operably connected to said opening of said inner hopper and extending to an exterior position relative said insulated shell, an outer injector comprising a self-filling syringe, pneumatic device, and user control, wherein said self-filling syringe is operably connected to said transfer tube and configured to remove said viscous fluid from said inner hopper via said transfer tube.

2. The system of claim 1, wherein said heating element is configured to provide heat energy to said heat exchange fluid via resistance heating.

3. The system of claim 1, further comprising a sensor of said heater, wherein said sensor determines a temperature of said heat exchange fluid within said internal cavity.

4. The system of claim 3, further comprising a control board of said heater, wherein said control board regulates a flow of electricity from a power supply to said heating element in way that causes said heat exchange fluid to be heated by said heater to said specific temperature.

5. The system of claim 1, wherein said pump is configured to provide said heating element with said heat exchange fluid.

6. The system of claim 1, wherein said heat exchange mount is configured to transfer heat energy obtained from at least one of said insulated shell or said transfer tube to said viscous fluid contained within said outer injector in order to prevent said viscous fluid contained within said outer injector from becoming too viscous to flow through a needle of said self-filling syringe.

7. The system of claim 1, further comprising an air supply operably connected to said outer injector and said user control via a plurality of tubes, wherein a first manipulation of said user control causes a first transfer of air to said outer injector from said air supply that causes said pneumatic device to actuate in a way that causes self-filling syringe to eject said viscous fluid, wherein a spring causes said self-filling syringe to return said self-filling syringe to a starting position that results in said self-filling syringe to fill with said viscous fluid.

8. The system of claim 7, wherein said air supply is operably connected to a top opening of said inner hopper via an air tube, wherein said air tube facilitates a transfer of air from said air supply and into said inner hopper in way that regulates a pressure within said inner hopper.

9. The system of claim 8, wherein said transfer tube is at least partially positioned within said heat exchange mount.

10. The system of claim 1, further comprising a motor and agitator assembly secured to said inner hopper, wherein a stirring element of said motor and agitator assembly is configured to agitate said viscous fluid contained within said inner hopper.

11. A system for filling containers with a viscous fluid comprising, a vessel having an insulated shell and a heat exchange mount, wherein said insulated shell has an internal cavity filled with a heat exchange fluid, wherein said insulated shell allows for said heat exchange fluid to transfer heat to said heat exchange mount, a heater having a heating element and pump, wherein said heater is secured to a top surface of said insulated shell of said vessel, wherein said heating element of said heater is positioned within said heat exchange fluid contained within said internal cavity of said vessel, wherein said heating element of said heater is configured to heat said heat exchange fluid to a specific temperature, wherein said pump is configured to regulate a flow of heat exchange fluid within said internal cavity, an inner hopper configured to hold said viscous fluid, wherein said inner hopper is secured to said top surface of said insulated shell of said vessel, wherein said inner hopper is positioned within said heat exchange fluid contained within said internal cavity of said vessel, wherein a top opening of said inner hopper allows for regulation of an internal pressure within said inner hopper, wherein a second opening of said inner hopper allows for removal of said viscous fluid from said inner hopper, a transfer tube operably connected to said second opening of said inner hopper and extending to an exterior position relative said insulated shell, an outer injector comprising a self-filling syringe, pneumatic device, and user control, wherein said self-filling syringe is operably connected to said transfer tube and configured to remove said viscous fluid from said inner hopper via said transfer tube, and an air supply operably connected to said outer injector and said user control via a plurality of tubes, wherein a first manipulation of said user control causes a first transfer of air to said outer injector from said air supply that causes said pneumatic device to actuate in a way that causes self-filling syringe to eject said viscous fluid, wherein a spring causes said self-filling syringe to return said self-filling syringe to a starting position that results in said self-filling syringe to fill with said viscous fluid.

12. The system of claim 11, wherein said heating element is configured to provide heat energy to said heat exchange fluid via resistance heating.

13. The system of claim 11, further comprising a sensor of said heater, wherein said sensor determines a temperature of said heat exchange fluid within said internal cavity.

14. The system of claim 13, further comprising a control board of said heater, wherein said control board regulates a flow of electricity from a power supply to said heating element in way that causes said heat exchange fluid to be heated by said heater to said specific temperature.

15. The system of claim 11, wherein said pump is configured to provide said heating element with said heat exchange fluid.

16. The system of claim 11, wherein said air supply is operably connected to a top opening of said inner hopper via an air tube, wherein said air tube facilitates a transfer of air from said air supply and into said inner hopper in way that regulates a pressure within said inner hopper.

17. The system of claim 16, wherein said transfer tube is at least partially positioned within said heat exchange mount.

* * * * *